US006088549A

United States Patent [19]

Kagawa et al.

[11] Patent Number: 6,088,549

[45] Date of Patent: Jul. 11, 2000

[54] FIXING DEVICE HAVING AN EXTERNALLY-HEATED FIXING ROLLER

[75] Inventors: Toshiaki Kagawa, Sakurai; Taisuke Kamimura, Kitakatsuragi-gun; Toshihiro Tamura, Sakurai; Syougo Yokota, Fujiidera, all of Japan

[73] Assignee: Sharp Kabushiki Kaisha, Osaka, Japan

[21] Appl. No.: 08/947,092

[22] Filed: Oct. 8, 1997

[30] Foreign Application Priority Data

Oct. 29, 1996 [JP] Japan ..... 8-287120

[51] Int. Cl.[7] ..... G03G 15/20

[52] U.S. Cl. ..... 399/67; 399/69

[58] Field of Search ..... 399/328, 67–70, 399/330; 219/216

[56] References Cited

U.S. PATENT DOCUMENTS

| | | | |
|---|---|---|---|
| 3,945,726 | 3/1976 | Ito et al. . | |
| 4,114,021 | 9/1978 | Nishide et al. | 219/216 |
| 4,984,027 | 1/1991 | Derimiggio et al. . | |
| 5,247,336 | 9/1993 | Mills, III | 399/70 |
| 5,280,329 | 1/1994 | Akiyama et al. | 399/330 |
| 5,289,248 | 2/1994 | Kurokawa | 399/70 |
| 5,450,183 | 9/1995 | O'Leary . | |
| 5,666,627 | 9/1997 | Yamaguchi | 399/330 |
| 5,713,069 | 1/1998 | Kato | 399/330 |

FOREIGN PATENT DOCUMENTS

| | | |
|---|---|---|
| 0336754 | 10/1989 | European Pat. Off. . |
| 0707244 | 4/1996 | European Pat. Off. . |
| 50-62448 | 5/1975 | Japan . |
| 51-70648 | 6/1976 | Japan . |
| 52-131731 | 11/1977 | Japan . |
| 57-122467 | 7/1982 | Japan . |
| 62-187372 | 8/1987 | Japan . |
| 63-313182 | 12/1988 | Japan . |
| 4-358186 | 12/1992 | Japan . |
| 5-2349 | 1/1993 | Japan . |
| 06035352 | 2/1994 | Japan . |
| 6-318001 | 11/1994 | Japan . |
| 7-241933 | 9/1995 | Japan . |

OTHER PUBLICATIONS

Externally Heated Fuser Roller, Research Disclosure, No. 321, Jan. 1, 1991, p. 77, XP000164464.

*Primary Examiner*—Quana Grainger
*Attorney, Agent, or Firm*—David G. Conlin; David A. Tucker

[57] ABSTRACT

In a fixing device, a sheet of paper carrying an image formed with pre-fixed toner is transported to a fixing nip region in which (1) a fixing roller heated by a heating roller outside of the fixing roller and (2) a pressure roller come into contact, so that the toner is melted and fixed on the sheet of paper. The heating roller is controlled so that a surface portion of the fixing roller in the vicinity of an exit of the fixing nip region constantly has a set temperature during the transport of the sheet of paper through the fixing nip region. By thus arranging a fixing device, the resultant fixing device features a short warm-up period, high thermal efficiency and uniform temperature distribution, capability of fixing color toner without application of oil, durability and safety, a simple structure and a low manufacturing cost, no curling of paper after fixation, and applicability to high-speed printing.

16 Claims, 10 Drawing Sheets

FIXING DEVICE HAVING AN EXTERNALLY-HEATED FIXING ROLLER

FIELD OF THE INVENTION

The present invention relates to a fixing device for use in an electrophotographic apparatus utilizing an electrophotographic process, such as a copying machine, a facsimile machine, or a printer, and particularly relates to an electrophotographic apparatus which is capable of color printing.

BACKGROUND OF THE INVENTION

Conventionally, a fixing device for use in an electrophotographic apparatus utilizing an electrophotographic process, such as a copying machine, a facsimile machine, or a printer, has been equipped with, for example, a fixing roller 101 and a pressure roller 102 which is pressed against the fixing roller 101, as illustrated in FIG. 9. Inside the fixing roller 101, a heater lump 103 as a heat source is provided, so that a surface of the fixing roller 101 is heated from inside.

The fixing roller 101 is composed of a fixing roller core 101*a* and a rubber layer 101*b* which covers the fixing roller core 101*a*.

The pressure roller 102 is composed of a pressure roller core 102*a* and a rubber layer 102*b* which covers the pressure roller core 102*a*.

The fixing device with these components is arranged so that a sheet of paper P (recording material) carrying thereon an image formed with pre-fixed toner T is transported to a region (fixing region) 108 where the fixing roller 101 heated to a desired set temperature and the pressure roller 102 come into contact, and the toner T is fused with heat and fixed on the sheet of paper P. Such a fixing device in which the heat source such as the heater lump 103 or the like is provided in the fixing roller 101 to heat the surface of the fixing roller 101 is referred to as a fixing device of inside heating type.

In the case where the toner carried on the sheet of paper P does not have a good releasing property, that is, for example, in the case of color toner, adhesion of the toner to the surface of the fixing roller 101, namely, an offset phenomenon, occurs on the fixing of the toner. Therefore, the fixing device is equipped with an oil applying unit 105 for applying oil on the surface of the fixing roller 101. The oil applying unit 105 is arranged so that oil 104 for preventing such an offset phenomenon is applied to the surface of the fixing roller 101 through a pair of oil applying rollers 107.

Incidentally, when the fixing device is of a type with an internal heating unit, it takes a long time to heat the surface of the fixing roller 101 to a set temperature (the toner fixation temperature) since the fixing roller 101, which has a great thermal capacity, is heated from the inside by the heater lump 101. (The period of time required to heat the fixing roller 101 to a set temperature is hereinafter referred to as the warm-up period.

As a fixing device which requires a shorter warm-up period, the Japanese Publications for Laid-Open Patent Application No. 50-62448/1975 (Tokukaisho 50-62448), No. 51-70648/1976 (Tokukaisho 51-70648), and No. 52-131731/1977 (Tokukaisho 52-131731) disclose a fixing device in which a surface of a fixing roller is heated by a heat roller (heat source) which is provided in contact with the surface of the fixing roller, that is, a fixing device of outside heating type. This fixing device of outside heating type has an excellent thermal efficiency since the heat source is in contact with the surface of the fixing roller, and hence the warm-up period required to heat the fixing roller to a set temperature necessary for fixation is considerably reduced.

Recently, the Japanese Publications for Laid-Open Patent Applications No. 63-313182/1988 (Tokukaisho 63-313182), No. 4-358186/1992 (Tokukaihei 4-358186), and No. 5-2349/1993 (Tokukaihei 5-2349) have disclosed a fixing device arranged so that a sheet of paper carrying a pre-fixed toner image is heated through a thin endless film (endless belt) which moves in synchronization with the sheet of paper, so that the toner is fixed. (Such a fixing device is hereinafter referred to as a fixing device of film heating type.)

The fixing device of film heating type is arranged, for example, as follows: as illustrated in FIG. 10, a sheet of paper P carrying an image formed with pre-fixed toner T is transported to a region where (1) a fixing belt 201 which is formed in an endless belt form and is stretched in a recording material transporting direction and (2) a pressure roller 203 come into contact, so that the image of the pre-fixed toner T is fixed on the sheet of paper P.

A heating body 202 is provided vis-a-vis the pressure roller 203 with the fixing belt 201 therebetween so that a fixation region 204 formed between the fixing belt 201 and the pressure roller 203 is heated. Therefore, the paper P transported through the fixation region 204 is heated with thermal energy from the heating body 202, and the toner carried on the paper P is fused and fixed thereon.

The fixing device as described above is arranged so that the sheet of paper P on which the toner has been fixed is naturally cooled down when it is transported to a downstream side of the fixing belt 201 (this cooling phenomenon is hereinafter referred to as self-cooling effect), so that the paper P separates from the fixing belt 201. Therefore, in the fixing device of film heating type, the toner-fixed paper P is cooled down when it comes to the downstream part of the fixing belt 201, and hence no adhesion of the toner to the fixing belt 201 occurs. As a result, application of oil for preventing an offset phenomenon is unnecessary. As the fixing belt 201, a belt which is made of a heat-resistant resin such as polyimide and is covered with a material having a good releasing property, such as a fluorocarbon resin, is usually used.

In the fixing device of film heating type, the fixing belt 201 may have a small thermal capacity, thereby causing the sheet of paper with the toner T to be cooled by radiation of heat immediately after passing through the fixation region 204 as a heated region. This causes the cohesive force of the toner T to increase, thereby causing the adhesive force to the fixing belt 201 to relatively decrease as the toner T is cooled down. Therefore, the offset can be prevented in principle.

The Japanese Publication for Laid-Open Patent Application No.6-318001/1994 (Tokukaihei 6-318001) discloses a fixing device of film heating type in which heating of a film (belt) with a small thermal capacitance is carried out on an upstream side to a fixing nip region. Therefore, the film is naturally cooled down in the fixing nip region (self-cooling effect) since heat of the film is taken by toner and paper. As a result, a temperature of the fused toner does not become extraordinarily high, and offset is prevented.

However, the aforementioned conventional fixing devices of various types have the following problems.

(I) Problems of the Fixing Device of Inside Heating Type

In order to achieve sufficient fixation, it is necessary to increase a heat quantity for fixation. In the color printing, in particular, in which multi-layer toner fixation is conducted, a great amount of thermal energy is required. As a method for increasing the heat quantity for fixation, there are two alternatives: raising the temperature of the fixing roller; and widening the fixing nip region which is a region where the fixing roller and the pressure roller come into contact.

However, in the case where the temperature of the fixing roller is raised, the offset phenomenon more likely occurs, while a service life of the fixing roller is shortened.

On the other hand, as a method for widening the nip width of the fixing nip region, there are following alternatives: (a) thickening the rubber layer 101*b* covering the fixing roller 101; (b) increasing the pressing force of the pressure roller 102; and (c) thickening the rubber layer 102*b* covering the pressure roller core 102*a* of the pressure roller 102.

In the case of the method (a), the rubber layer 101*b* becomes thicker, and this causes thermal conductivity to deteriorate. This further causes a drawback in that the period of time required to achieve the fixation temperature of the fixing device, that is, the warm-up period, becomes longer. Besides, there occurs another drawback in that a temperature of an interface between the fixing roller core 101*a* and the rubber layer 101*b* of the fixing roller 101 rises, thereby as a result causing deterioration of the rubber layer 101*b* and separation of the same from the fixing roller core 101*a*.

In the case of the method (b), it is necessary to thicken the fixing roller core 101*a* of the fixing roller 101 so as to prevent deformation of the fixing roller 101 due to the pressure of the pressure roller 102. In this case as well, there occurs a drawback in that the thermal conductivity deteriorates, thereby causing the warm-up period to become longer.

In the case of the method (c), the sheet of paper P is pressed against the fixing roller 101 by the pressure roller 102 so as to conform with the shape of the fixing roller 101. As a result, the paper P is caught by the fixing roller 101, and it becomes difficult to separate the paper P from the fixing roller 101.

In the case of the method (c), to prevent the paper P from being caught by the fixing roller 101 and to separate the paper P from the fixing roller 101 without failure, it is necessary to provide a separating claw 106 in contact with the fixing roller 101, as illustrated in FIG. 9. However, in this case, the following problems occur:

(i) the device has a complicated arrangement, and a manufacturing cost of the device rises;

(ii) the surface of the fixing roller 101 is scarred by the separating claw 106;

(iii) an image is distorted due to the contact of the separating claw 106 to the surface of the paper on which the image is held. In the case of color printing, in particular, the distortion of the image is conspicuous; and (iv) the sheet of paper P curls due to the separating claw 106.

In addition, in the fixing device, temperature detecting means such as a thermostat or a temperature fuse is provided near the fixing roller, so that it serves as a security device in the case where a trouble occurs to temperature controlling means or the like, causing a temperature of the fixing roller to extraordinarily rise. However, in the case where the temperature detecting means is provided in contact with the fixing roller so as to detect troubles in an early stage, there occurs a drawback in that the surface of the fixing roller is scarred. Besides, in the case where the temperature detecting means is provided not in contact with the fixing roller so that the fixing roller should not be scarred, the response of the temperature detecting means to an extraordinary state is delayed, thereby causing a delay in preventing the temperature of the fixing roller from rising. This results in that damage to the fixing device and the apparatus incorporating the fixing device is aggravated.

Furthermore, in the case where the oil 104 for preventing offset is applied to the surface of the fixing roller 101, the following drawbacks occur:

(i) a complicated system is needed to apply the oil 104 evenly over the fixing roller 101, causing the cost of the device to rise;

(ii) due to the oil 104, the rubber layer 101*b* of the fixing roller 101 deteriorates and swells, causing the service life of the fixing roller 101 to become shorter;

(iii) spill of the oil 104 soils the device and reversely affect other parts of the apparatus;

(iv) the oil 104 soils the sheet of paper P, thereby soiling hands of the user and making him/her feel unpleasant;

(v) in the case where OHP is used as the sheet of paper P, the oil 104 soils the surface of the OHP, thereby lowering the transparency of the OHP; and (vi) regular maintenance such as supply of the oil 104 is required, and this makes the device not user-friendly.

(II) Problems of the Fixing Device of Outside Heating Type

Since no heat is supplied in the fixing nip region, heat of the surface of the fixing roller is taken by the paper and the toner and the temperature of the surface of the fixing roller drops in the fixing nip region. As a result, a temperature gradient is caused between the upstream end (entrance) and the downstream end (exit) of the fixing nip region. This phenomenon is hereinafter referred to as self-cooling effect.

The temperature gradient due to the self-cooling effect considerably varies with the types of paper, an ambient temperature, and the number of sheets of paper which have been transported therethrough. For example, the temperature gradient is sharper as the paper is thicker, while the temperature gradient is sharper as the ambient temperature is lower.

Therefore, the conventional fixing device of outside heating type is necessarily arranged as follows: a temperature of the fixing roller just after being heated by the outside heating roller, that is, a temperature of a surface portion of the fixing roller on the upstream side to the fixing nip region with respect to the rotation direction of the fixing roller, is detected by the temperature detecting means, and the outside heating roller is controlled so that the temperature thus detected is converged to the set temperature. However, in the fixing device of outside heating type, as described before, due to the self-cooling effect, the temperature gradient in the fixing nip region varies with fixing conditions. Therefore, there occurs a drawback in that it is difficult to achieve a stable fixing property at all times.

Furthermore, in the case where sheets of paper with a narrower width than the width of the fixing roller, such as postcards or envelopes, are continuously transported through the fixing nip region, heat is not taken from portions of the fixing roller which do not touch the sheets of paper, and the surface temperature of the portions extraordinarily rises. Therefore, there occur problems of rise of a temperature inside an apparatus incorporating the fixing device, and adhesion of toner to the fixing roller, that is, an offset phenomenon (so-called high-temperature offset phenomenon).

In the case where toner with an inferior releasing property is used in the fixing device of outside heating type, offset, that is, adhesion of toner over the fixing roller surface, occurs as in the case of the fixing device of inside heating type. Therefore, the oil applying system is required so as to apply oil to the surface of the fixing roller. As a result, as in the case of the fixing device of inside heating type, various drawbacks occur due to the application of the offset-prevention oil to the fixing roller.

(III) Problems of the Fixing Device of Film Heating Type

The fixing device of film heating type has an advantage in that application of oil for preventing offset is not required. Besides, since a film which is used as fixing means of the fixing device has a small thermal capacity as compared with a fixing roller, the warm-up period can be shortened.

However, as illustrated in FIG. 10, since the fixing belt 201 is shaped in an endless belt form, systems for controlling tension applied to the fixing belt 201, preventing the fixing belt 201 from meandering, and preventing wrinkles from occurring to the fixing belt 201 due to thermal expansion, are required. Therefore, a driving system for the fixing belt 201 becomes very complicated, thereby raising the cost of the device.

Besides, since the fixing belt 201 is formed thin so as to have a small thermal capacitance, its service life is shorter than that of the fixing roller in a roll shape. Particularly, since the fixing belt 201 rubs against the heating body 202, the fixing belt 201 is worn away, and a service life of the fixing belt 201 becomes shorter. Besides, in the case where the rotation of the fixing belt is speeded up so as to speed up the printing, the service life of the fixing belt becomes further shorter. Therefore, it cannot be applied to an electrophotographic apparatus whose printing speed is high.

By thickening the fixing belt 201, the aforementioned problems can be solved to some extent. However, the thermal capacity of the fixing belt 201 increases also by thickening the fixing belt 201. This causes the warm-up period to become longer, and hence the advantage of the fixing device of film heating type, in that a shorter warm-up period is required, is lost.

Furthermore, in the case where the fixing belt 201 has a greater thermal capacity, the toner on the sheet of paper cannot be sufficiently cooled after the fixation until it becomes solid, and as a result offset likely occurs. Therefore, to prevent the offset phenomenon, cooling means such as ventilation means is required on the downstream side in the transport direction of the fixing belt 201 so as to cool the toner on the paper after the fixation until it becomes solid. In this case, the thermal efficiency deteriorates, and the device becomes complicated and bulky.

SUMMARY OF THE INVENTION

The object of the present invention is to provide a fixing device which features: (i) a short warm-up period, high thermal efficiency and uniform temperature distribution; (ii) capability of fixing color toner without application of oil; (iii) durability and safety; (iv) a simple structure and a low manufacturing cost; (v) no curling of paper after fixation; and (vi) applicability to high-speed printing.

To achieve the above object, the fixing device of the present invention comprises a fixing roller and pressure means for pressing a circumferential surface of the fixing roller, the fixing roller and the pressure means coming into contact in a heated contact region to which a recording material with a pre-fixed toner image thereon is transported so that the toner is melted with heat and fixed on the recording material, wherein the fixing roller is controllably heated from outside so that a surface portion of the fixing roller in a vicinity of an exit of the contact region constantly has a predetermined temperature during transport of the recording material through the contact region.

Since a method of heating the fixing roller surface from outside (outside heating method) is applied to the above fixing device, the fixing roller surface is more efficiently heated, as compared with the device to which a method of heating the fixing roller surface from inside (inside heating method) is applied. Therefore, the warm-up period of the fixing roller can be shortened. Besides, since the outside heating method is applied, the surface temperature of the fixing roller has fallen to a predetermined temperature at the exit of the contact region due to the self-cooling effect, and as a result offset can be prevented. Besides, since the heating operation is controlled so that the temperature of the surface portion of the fixing roller in the vicinity of the exit of the contact region is kept to a predetermined level, it is possible to eliminate extraordinary temperature rise which, as a disadvantage of the conventional outside-heating-type device, tends to occur to the fixing roller in the case where the fixing operation is continuously carried out with respect to sheets of paper narrower than the width of the fixing roller, such as postcards.

For a fuller understanding of the nature and advantages of the invention, reference should be made to the ensuing detailed description taken in conjunction with the accompanying drawings.

DESCRIPTION OF THE PREFERRED EMBODIMENTS

First Embodiment

The following description will explain an embodiment of the present invention while referring to FIGS. 1 through 7. Note that the following description on the first embodiment explains a case where a fixing device of the present invention is applied in a monochromatic laser printer as an electrophotographic apparatus.

Figure 2:
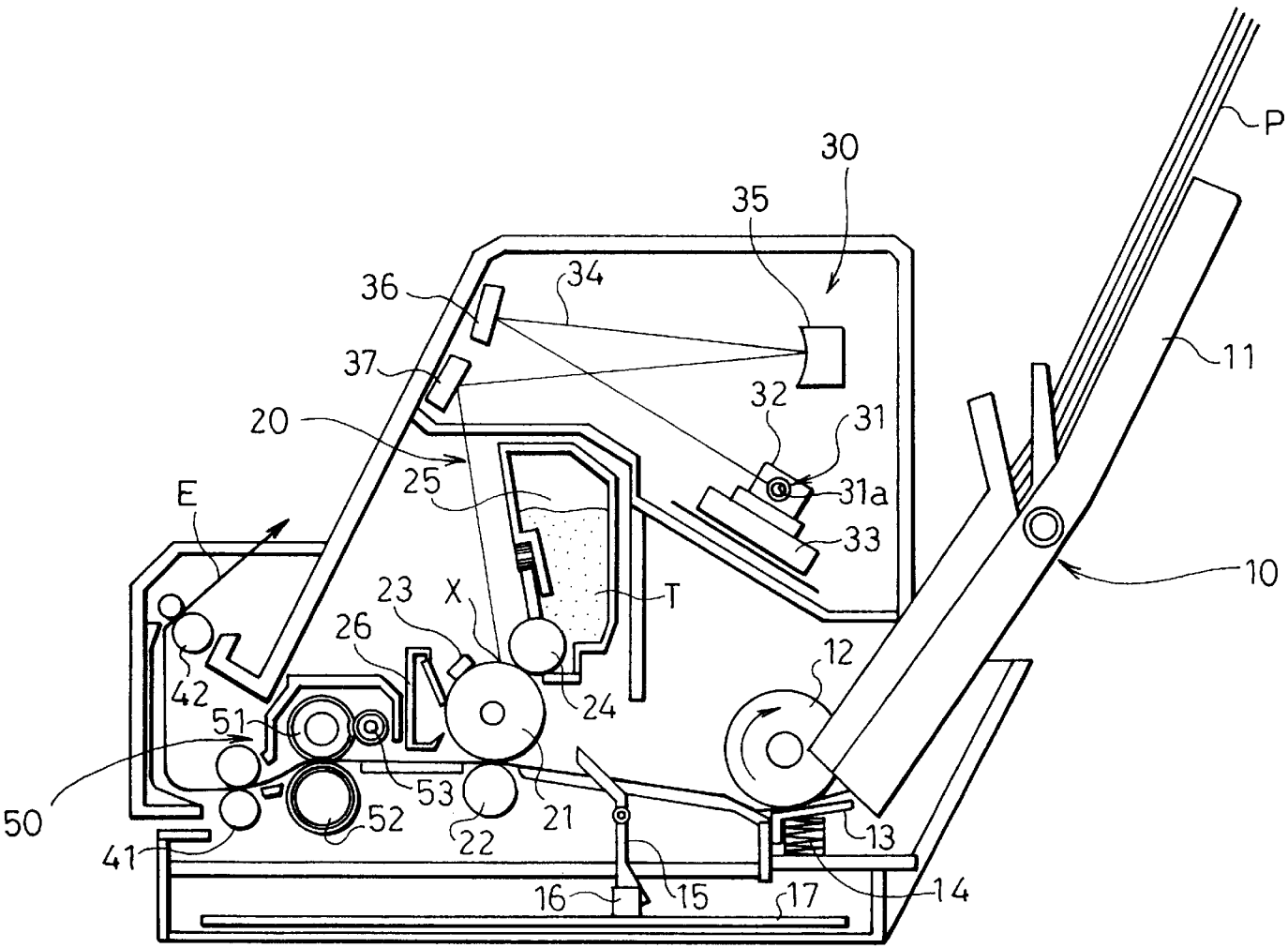
FIG. 2 is a view illustrating a schematic arrangement of a laser printer incorporating the fixing device shown in FIG. 1.

The laser printer in accordance with the present embodiment has a paper feeding unit 10, an image forming device 20, a laser scanning unit 30, and a fixing device 50, as illustrated in FIG. 2.

In the laser printer, a sheet of paper P is transported from the paper feeding unit 10 to the image forming device 20. In the image forming device 20, a toner image is formed in accordance with a laser light 34 controlled by the laser scanning unit 30, and the toner image is transferred onto the sheet of paper P as a recording material, which has been transported thereto. The sheet of paper P on which the toner image has been transferred is transported to the fixing device 50, where the toner image is fixed on the sheet of paper P. Finally, the sheet of paper P on which the toner image has been fixed is discharged to outside the apparatus by paper discharging rollers 41 and 42 which are disposed on a downstream side to the fixing device 50 in a paper transport direction. In other words, along a route indicated by an arrow E in FIG. 2, the sheet of paper P is transported through the paper feeding unit 10, the image forming device 20, and the fixing device 50 in this order and is discharged to outside the apparatus.

The paper feeding unit 10 is composed of a paper tray 11, a paper feeding roller 12, a paper separating friction board 13, a pressure spring 14, a paper detecting actuator 15, a paper detecting sensor 16, and a control circuit 17.

The paper tray 11 is capable of containing a plurality of sheets of paper P. The paper feeding roller 12, by rotating in an arrow direction, feeds sheets of paper P contained in the paper tray 11 toward the image forming device 20. Herein, the paper separating friction board 13 is pressed onto the paper feeding roller 12 by the pressure spring 14, so that the plural sheets of paper P in the paper tray 11 are separated one by one. The paper detecting sensor 16 is composed of, for example, an optical sensor, and the paper detecting actuator 15 is composed of a member which can be inclined in the paper transport direction by the sheet of paper P which is being sent out by the paper feeding roller 12. To be more specific, when the paper detecting actuator 15 is not inclined, an optical path is blocked and the paper detecting sensor 16 exhibits an OFF state. On the other hand, when the paper detecting actuator 15 is inclined, the optical path is not blocked and the paper detecting sensor 16 exhibits an ON state.

Therefore, the paper detecting sensor 16 becomes the ON state when the paper detecting actuator 15 is inclined. Thus, the paper detecting sensor 16 detects that the sheet of paper P has been transported to the image forming device 20, and outputs a detection signal to the control circuit 17.

In response to the detection signal from the paper detecting sensor 16, the control circuit 17 sends an image signal to a laser diode light emitting element 31 of the laser scanning unit 30, so as to control turning on/off of a light emitting diode 31*a*. Note that the control circuit 17 also serves as heating control means of the fixing device 50 which will be described later.

The laser scanning unit 30 has the laser diode light emitting element 31, a scanning mirror 32, a scanning mirror motor 33, and reflection mirrors 35, 36, and 37.

The scanning mirror motor 33 is provided under the scanning mirror 32, and is arranged so as to rotate the scanning mirror 32 at a constant, high speed. The laser diode light emitting element 31 is provided on the scanning mirror 32, so as to rotate along with the scanning mirror 32. In other words, while the laser diode light emitting unit 31 rotates at a constant high speed, the light emitting diode 31*a* of the laser diode light emitting unit 31 emits the laser light 34 to the reflection mirror 36. The laser light 34 is reflected by the reflection mirrors 36, 35, and 37 in this order, and is guided to an exposure point X of t he image forming device 20.

The laser diode light emitting unit 31 is arranged so as to selectively expose a photosensitive body 21 of the image forming device 20, in accordance with turning on/off information supplied from the control circuit 17.

The image forming device 20 is equipped with the photosensitive body 21, a transfer roller 22, a charging member 23, a developing roller 24, a developing unit 25, and a cleaning unit 26.

Electric charges which have previously been given to a surface of the photosensitive body 21 by the charging member 23 are selectively discharged due to the laser light 34 from the laser scanning unit 30, and as a result an electrostatic latent image is formed thereon.

In the developing unit 25, the developing roller 24 for supplying toner T to the photosensitive body 21 is installed. By agitating the toner T contained in the developing unit 25, the toner T is charged, and is caused to adhere to a surface of the developing roller 24. By effects of an electric field formed due to a developing bias voltage given to the developing roller 24 and a potential of the surface of the photosensitive body 21, a toner image corresponding to the electric latent image formed on the surface of the photosensitive body 21 is formed on the photosensitive body 21.

Then, in the image forming device 20, utilizing effects of an electric field formed by a transfer voltage applied, the transfer roller 22 causes the toner image formed on the surface of the photosensitive body 21 to be attracted to, and transferred onto, the sheet of paper P which has been transported to between the photosensitive body 21 and the transfer roller 22. Herein, the toner T on the photosensitive body 21 is transferred onto the sheet of paper P by the transfer roller 22, and non-transferred toner T is collected by the cleaning unit 26.

The sheet of paper P on which the toner image has been transferred in the image forming device 20 is transported to the fixing device 50, where the toner image is fixed. To be more specific, in the fixing device 50, appropriate temperature and pressure are applied to the sheet of paper P by the pressure roller 52 and the fixing roller 51 whose surface temperature is kept at 180° C. Then, the toner T is fused and fixed on the sheet of paper P, forming a fixed image.

The sheet of paper P on which the toner image has been thus fixed by the fixing device 50 is transported to outside the apparatus by the paper discharging rollers 41 and 42.

Note that the fixing device 50, being the outside heating type, is arranged so that the fixing roller 51 is heated by the heating roller 53 which is provided in contact with the fixing roller 51.

Figure 4:
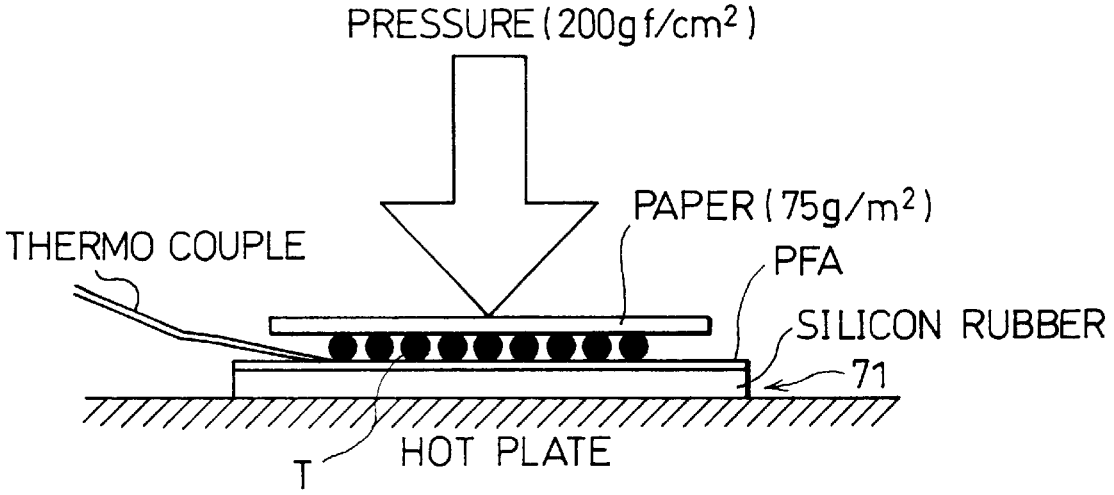
FIG. 4 is an explanatory view illustrating a method for an experiment for confirming an offset prevention effect.
Figure 5:
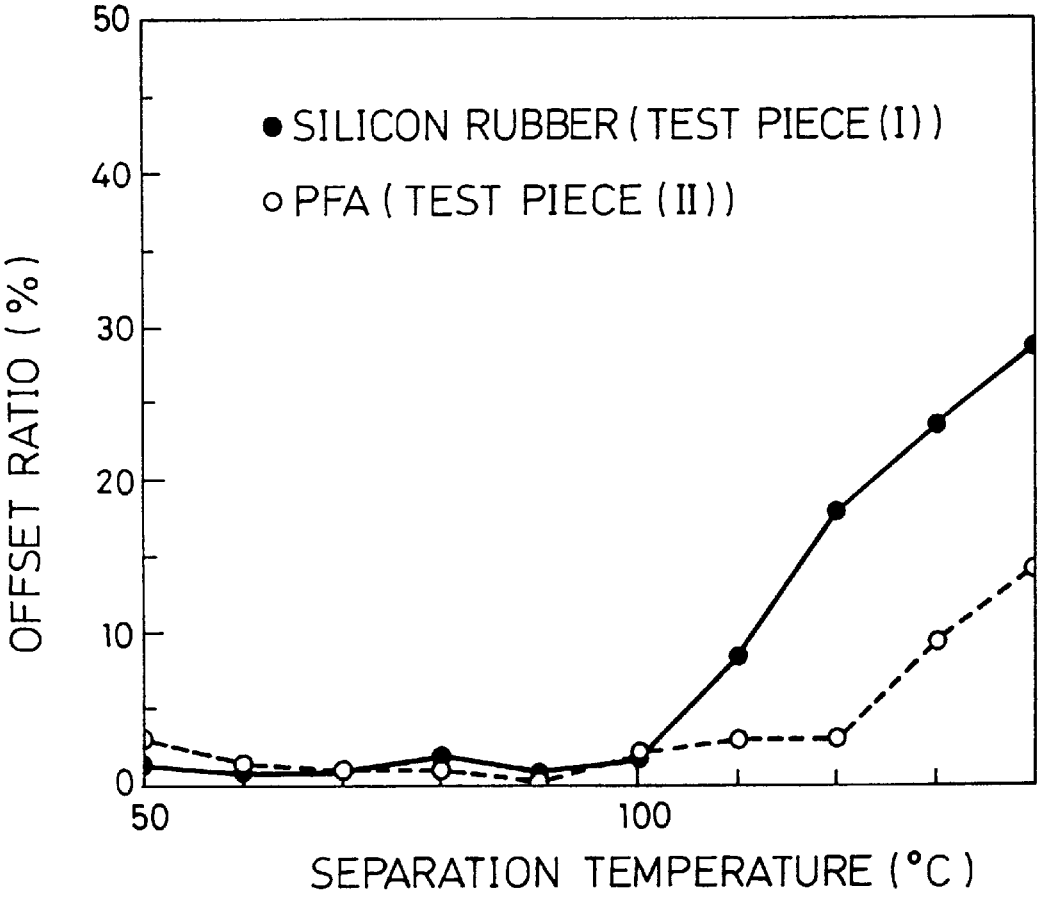
FIG. 5 is a graph illustrating a relation between a separation temperature and an offset ratio which are found in the experiment shown in FIG. 4.

Before explaining the fixing device 50 in detail, the following description will explain a principle of an offset prevention method utilizing the self-cooling effect of the fixing roller 51 which is arranged in accordance with the outside heating method, while referring to FIGS. 4 and 5.

The inventors of the present application have confirmed the offset prevention effect due to the self-cooling effect of the fixing roller, through theoretical experiment described as follows.

The experiment was conducted in a state shown in FIG. 4. Specifically, a test piece 71 was placed on a hot plate as a heat source, and then, the hot plate was turned on so as to heat the test piece 71 till the surface of the test piece 71 had a predetermined target temperature of 180° C. A thermocouple was used for temperature measurement. As the test piece 71, two types were prepared: one made of silicon rubber alone (test piece (I)); and one made of silicon rubber, on whose surface PFA was applied (test piece (II)). Note that FIG. 4 shows the test piece (II).

Subsequently, when the temperature of the surface of the test piece 71 reached 180° C., the hot plate was turned off, and a sheet of paper on which a pre-fixed toner image had been transferred was pressed against the surface of the test piece 71. The sheet of paper was woodfree paper (75 g/m$^2$), and 100 percent of the surface was covered with pre-fixed toner T. A pressure applied to the sheet of paper was set to 200 gf/cm$^2$.

By using ventilation means (not shown), the test piece 71 and the sheet of paper was cooled down. When the surface temperature of the test piece 71 fell to a certain level (hereinafter referred to as separation temperature), the sheet of paper was separated from the test piece 71.

Then, a density of toner T adhering to the surface of the test piece 71 after the sheet of paper was removed (a density of offset toner) was measured. An offset ratio was calculated by using the following formula, with a toner density of a test piece with no offset given as reference density of 100:

$$\text{OFFSET RATIO}(\%) = \frac{\text{DENSITY OF TONER ADHERING TO TEST PIECE}}{\text{REFERENCE DENSITY}}$$

Note that the toner T used in the experiment was color toner having a glass transition point of 50° C. and a melting point of 105° C.

A relation between the separation temperature and the offset ratio as the result of the aforementioned experiment is shown in FIG. 5. From the result, it is found that as the separation temperature lowers, the offset ratio rapidly drops, showing a decrease in the quantity of toner adhering to the test piece. As the reason of this, it can be considered that cohesion of toner particles is intensified as the toner temperature drops to below the melting point, and the cohesive force comes to exceed the adhesive force between the toner and the test piece. Therefore, prevention of offset without oil is theoretically possible, by lowering the temperature of the fixing roller to below the melting point prior to separating the toner fixed on the paper from the fixing roller.

Then, the inventors of the present application successfully invented a fixing device which is capable of avoiding offset, by lowering the separation temperature by utilizing the fall of temperature in the fixing nip region (self-cooling effect), which has been seen as a disadvantage in the conventionally-proposed outside heating method. To explain in more detail, since heat supply the fixing nip region is less in the fixing device of outside heating type as compared with the fixing device of inside heating type, heat is taken by the paper and the toner in the fixing nip region, and the temperature of the fixing roller surface has fallen in the vicinity of the exit of the fixing nip region. Therefore, by detecting the temperature of the portion which had been lowered and adjusting the temperature to the set level, the prevention of offset of the toner to the fixing roller and the stable fixation which has not been achieved by the conventional outside heating method could be achieved at the same time.

Moreover, from the result illustrated in Table 5, it is clear that the offset ratio was low at a high temperature in the case of the test piece made of silicon rubber covered with PFA (test piece (II)), as compared with the case of the test piece made of silicon rubber alone (test piece (I)). In the former case, the offset ratio was almost steady in a range of the separation temperature up to 120° C., and it remained low even when the temperature exceeded the melting point of the toner. Therefore, it was found that the test piece (II) was more preferable than the test piece (I).

Figure 1:
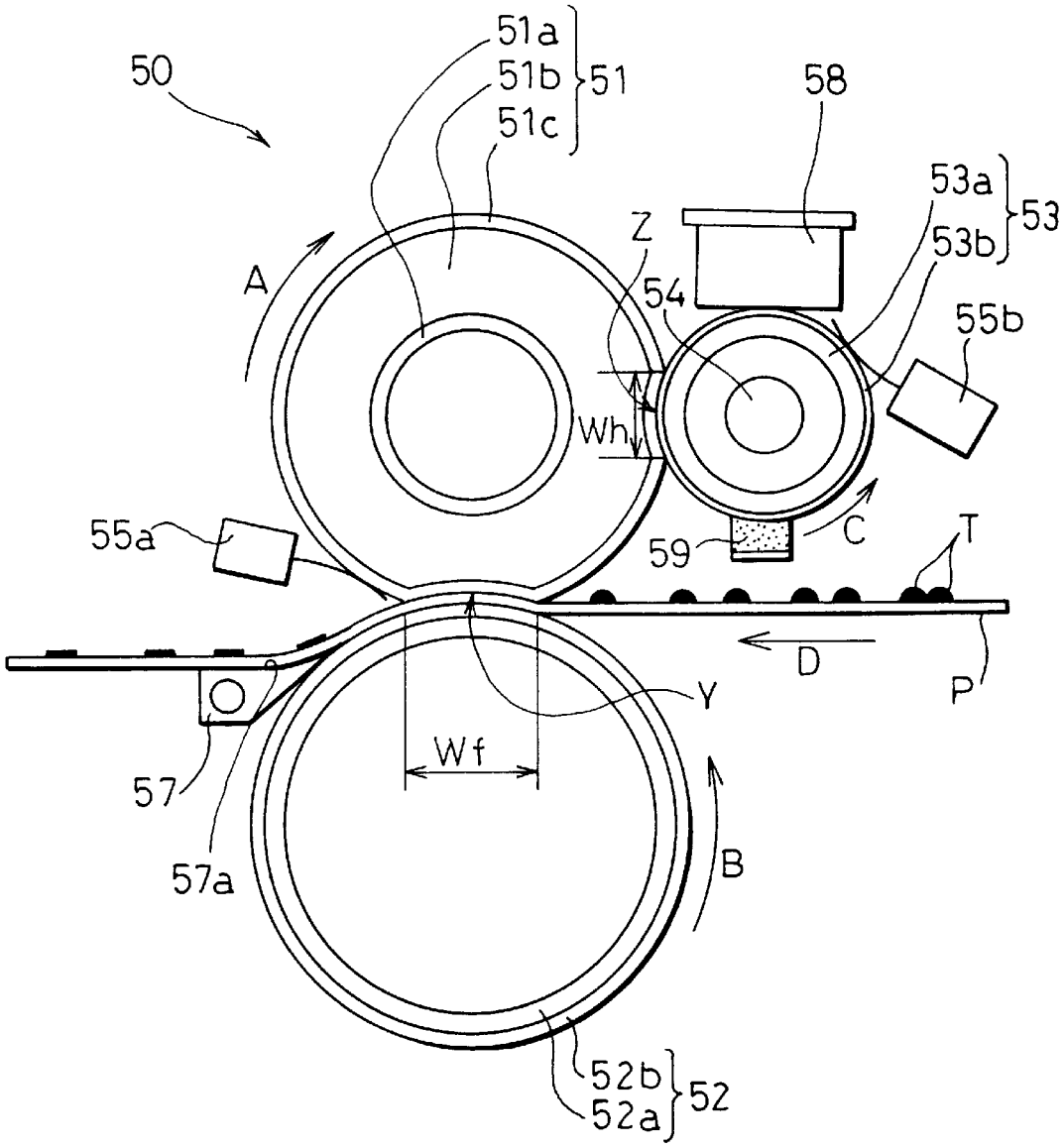
FIG. 1 is a view illustrating a schematic arrangement of a fixing device in accordance with one embodiment of the present invention.

Here, the following description will explain the fixing device 50, while referring to FIG. 1.

The fixing device 50 has a fixing roller 51, a pressure roller 52 as pressure means, and a heating roller 53 as heating means, as illustrated in FIG. 1. The fixing roller 51 and the pressure roller 52 are vertically disposed.

The fixing roller 51 is heat-resistant and elastic. A portion of the fixing roller 51 which is in contact with the pressure roller 52 and is pressed by the same is elastically deformed, while another portion of the fixing roller 51 which is in contact with the heating roller 53 and is pressed by the same is also elastically deformed.

The pressure roller 52 is arranged so as to take two states, one state where it is set away from the fixing roller 51 by a separating system (not shown) with a gap (3 mm in the present embodiment) therebetween, and the other state where it is pressed against the fixing roller 51 with a predetermined force. FIG. 1 illustrates the state where the pressure roller 52 is pressed against the fixing roller 51. A region in which the fixing roller 51 and the pressure roller 52 are in contact due to the elastic deformation of the fixing roller 51 is hereinafter referred to as a fixing nip region Y, and its width (fixing nip width) is given as Wf.

The fixing roller 51 is rotated in an arrow A direction by driving means (not shown) Since the pressure roller 52 is pressed against the fixing roller 51, the rotation of the fixing roller 51 causes the pressure roller 52 to rotate in an arrow B direction.

The heating roller 53 has a heater lump 54 as a heat source. The heater lump 54 is provided inside the heating roller 53, on an upstream side to the fixing nip region Y in a rotational direction of the fixing roller 51. Here, the heating roller 53 is provided so that its axis is substantially parallel to the axis of the fixing roller 51 and the heating roller 53 is pressed against the fixing roller 51 with a set pressure.

FIG. 1 illustrates a state where the heating roller 53 is pressed against the fixing roller 51, and a region where the fixing roller 51 and the heating roller 53 are in contact due to the elastic deformation of the fixing roller 51 is hereinafter referred to as a heating nip region Z, and its width (heating nip width) is given as Wh. In the present embodiment, the heating nip width Wh is 5 mm. Since the heating roller 53 is thus pressed against the fixing roller 51, the rotation of the fixing roller 51 causes the heating roller 53 to rotate in an arrow C direction.

On a circumferential surface of the heating roller 53, a thermistor **55*b* as temperature detecting means is provided so as to detect a temperature of the surface of the heating roller 53. A thermistor 55*a* is provided as temperature detecting means on a downstream side to the fixing nip region Y in the rotational direction of the fixing roller 51, so that the thermistor 55*a* detects a temperature of the surface of the fixing roller 51 after fixation. A separating claw 57 is provided in contact with the pressure roller 52 on a downstream side to the fixing nip region Y in a rotational direction of the pressure roller 52, so that the separating claw 57 prevents the sheet of paper P from being caught by the pressure roller 52** after fixation.

Detailed structures of the fixing roller 51, the pressure roller 52, and the heating roller 53 will be described later.

In the fixing device 50 arranged as described above, when printing is to be executed, the pressure roller 52 is set away from the fixing roller 51, and the fixing roller 51 rotates in the arrow A direction at a peripheral speed of 85 mm/sec, while the heating roller 53 is heated by the heater lump 54.

The surface temperature Th of the heating roller 53 is detected by the thermistor **55*b*, and the turning on/off of the heater lump 54 is controlled by the control circuit 17 in accordance with detection signals supplied from the thermistor 55***b*, so that the temperature Th reaches a predetermined level (220° C. in the present embodiment).

In the heating nip region Z, the surface of the fixing roller 51 is heated by the heating roller 53 thus heated, and the surface temperature of the fixing roller 51 is detected by the thermistor 55*a*. In response to a detection signal which is generated when the surface of the fixing roller 51 has a first temperature (180° C. in the present embodiment), the pressure roller 52 is driven so as to come into contact with the fixing roller 51. Then, a sheet of paper P carrying an image formed with pre-fixed toner T is transported, in an arrow D direction, from the image forming device 20 to the fixing nip region Y between the fixing roller 51 and the pressure roller 52.

The toner T, electrostatically adhering to the sheet of paper P which has been transported to the fixing nip region Y, is fixed thereon with heat of the fixing roller 51 and pressure in the fixing nip region Y. Herein, the control circuit 17 controls power supply to the heater lump 54 in accordance with the detection signals sent from the thermistor 55*a* so that a temperature To of a surface portion of the fixing roller 51 in the vicinity of the exit of the fixing nip region Y becomes a second temperature (80° C. in the present embodiment) which is lower than the first temperature.

After the fixation, the sheet of paper P is transported along the pressure roller 52, coming off from the fixing roller 51, and thereafter, it is separated from the pressure roller 52 by the separating claw 57.

Figure 3:
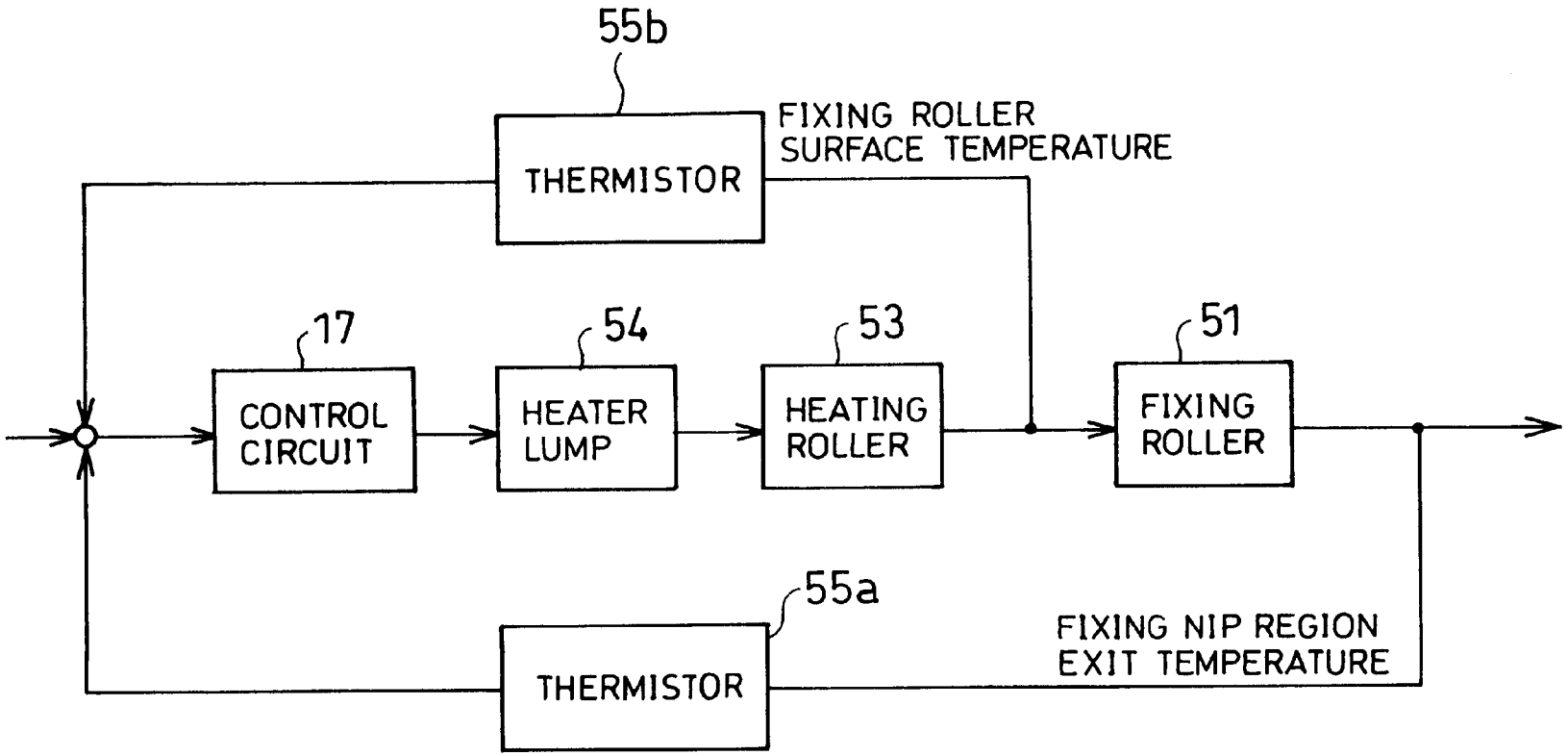
FIG. 3 is a block diagram illustrating a heating control circuit of the fixing device shown in FIG. 1.

Thus, as shown in FIG. 3, in the fixing device 50, the detection signal on the fixing roller surface temperature detected by the thermistor 55*b* is supplied to the control circuit 17, while a detection signal on the temperature at the exit of the fixing nip region which has been detected by the thermistor 55*a* is also supplied to the control circuit 17. The control circuit 17 controls the temperature of the heating roller 53 by controlling the heater lump 54 in accordance with the detection signals thus supplied thereto, so that the surface temperature of the fixing roller 51 and the temperature at the exit of the fixing nip region are kept at set levels. Therefore, the control circuit 17 also serves as heating control means for controlling operations of the heating roller 53.

Specifically, the control circuit 17 controls the heating operation of the heating roller 53 so that the surface temperature To and a toner melting point Tm satisfy the relation of To≦Tm. With this arrangement, a stable toner releasing property can be obtained at all times, irrelevant to ambient conditions, the number of sheets of paper P which have been transported through the fixing nip region, and types of the paper P, thereby preventing offset.

The following description will explain the fixing roller 51 in detail.

The fixing roller 51 has a diameter of 30 mm. As illustrated in FIG. 1, the fixing roller 51 has the following structure: an insulating layer 51*b* made of a heat-resistant elastic material is formed on a core 51*a*, and the insulating layer 51*b* is covered with a cover layer 51*c* made of a heat-resistant material having good releasing property.

The core 51*a* is intended for reinforcing the fixing roller 51. It has a cylindrical shape, or a hollow cylindrical shape, and is made of aluminum, stainless steel, or the like. Note that in the present embodiment a hollow cylindrical shaft made of stainless steel with a diameter of 15 mm and a thickness of 2 mm is used as the core 51*a*.

The insulating layer 51*b* is intended for preventing heat in the cover layer 51*c* heated by the heating roller 53 from being conducted to the inside of the fixing roller 51, and for being deformed due to its elasticity when pressed by the pressure roller 52, so that the fixing nip region Y has the set fixing nip width Wf.

As the heat-resistant elastic material of the insulating layer 51*b*, rubber materials having excellent heat resistance such as fluorocarbon rubber or silicon rubber are used. Table 1 below compares ratios of temperature rises of the fixing roller surfaces in the case where a solid silicon rubber is used as the insulating layer and in the case where an aerated silicon rubber is used as such. Note that the ratios of temperature rises were measured with respect to aerated silicon rubber and solid rubber which had the same rubber hardness, with the heating nip widths being set equal.

TABLE 1

| MATERIAL OF INSULATING LAYER | RUBBER HARDNESS (°) | HEATING NIP WIDTH Wh (mm) | TEMPERATURE RISING RATIO (° C./sec) |
|---|---|---|---|
| SILICON RUBBER (SOLID) | ASKER-C 40 | 5.5 | 0.95 |
| SILICON RUBBER (AERATED) | ASKER-C 40 | 5.5 | 3.7 |

From Table 1, it is found that the temperature rising ratio of the aerated silicon rubber was four times the temperature rising ratio of the solid silicon rubber, even though both of them were arranged so as to have the same rubber hardness so that the heating nip widths were equal. This is because the aerated silicon rubber contains air bubbles which contain air, whose heat conductivity is small, and hence the aerated silicon rubber is superior in insulation to the solid silicon rubber with no air bubbles inside. Thus, it is found that temperature rise in the aerated silicon rubber is much slower than that of the solid silicon rubber, and therefore the former is much more excellent in insulation than the latter. Therefore, in the present embodiment, aerated silicon rubber formed 7.5 mm thick is used as the insulating layer 51*b*.

Incidentally, the aerated silicon rubber is classified into two in respect of bubble forms: one having bubbles which are each discrete; and the other having bubbles which are concatenated with each other. Therefore, in the case where the aerated silicon rubber used for the insulating layer 51*b* is a discrete-bubble type, the fixing roller swells due to volume expansion of air in the bubbles due to heat, and this causes a problem in that the sheet of paper is wrinkled during the fixing operation.

Figure 6:
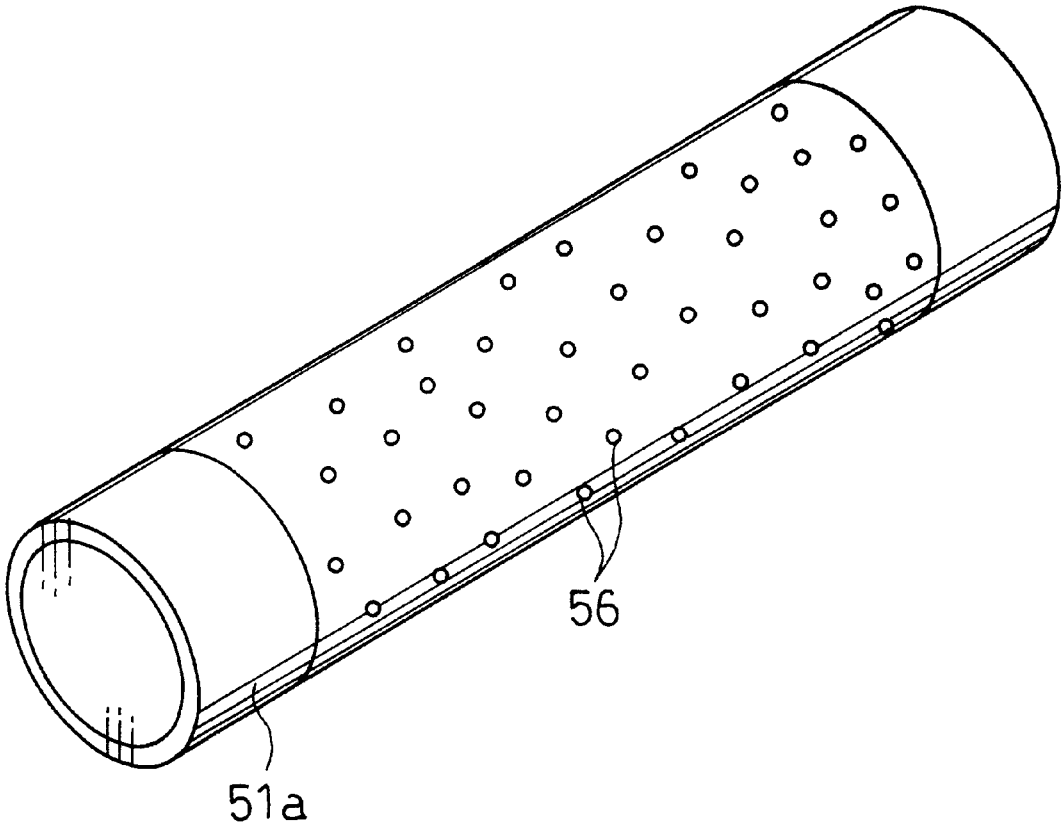
FIG. 6 is a perspective view illustrating a core of a fixing roller installed in the fixing device shown in FIG. 1.

Therefore, in the present invention, the aerated silicon rubber of concatenated-bubble type is used, while a hollow cylinder with a plurality of piercing pores 56 with a diameter of 1 mm, as illustrated in FIG. 6, is used as the core 51*a*. With this arrangement, air which has been expanded in the bubbles of the silicon rubber due to heating can be discharged to outside through the bubbles concatenated with each other and the piercing pores 56 of the core 51*a*. Therefore, even when being heated, the diameter of the fixing roller is kept constant at all times.

The cover layer 51*c* is aimed at (1) being heated by the heating roller 53 in the heating nip region Z so that the heat thus received is given to the toner T on the sheet of paper P in the fixing nip region Y so as to fix the toner T thereon, and (2) avoiding the soiling of the surface of the fixing roller 51 due to adhesion of the toner T and the like thereto.

Heat-resistant materials having an excellent releasing property, suitable for use as a material of the cover layer 51*c*, are fluorocarbon resins such as PFA (tetrafluoroethylene-perfluoroalkyl vinyl ether copolymer resin) and PTFE (polytetrafluoroethylene resin). PFA, in particular, has an excellent releasing property with respect to toner, as compared with the silicon rubber, as shown in FIG. 5. On top of that, PFA can be easily formed in a thin film form, as compared with PTFE. Therefore, in the present embodiment, a PFA tube with a thickness of 50 $\mu$m is used as the cover layer 51*c*.

Besides, the cover layer 51*c* is also intended for reducing irregular fixation due to air bubbles in the case where the aerated silicon rubber is used as the insulating layer.

The following description will explain the heating roller 53 in more detail.

The heating roller 53 has the following structure. As shown in FIG. 1, the heating roller 53 has a core 53*a* in a hollow cylindrical form, which is made of aluminum, stainless steel, or the like. The core 53*a* is covered with a heat-resistant release layer 53*b* made of a synthetic resin material having a excellent heat resistance and an excellent releasing property, for example, a polymer material such as silic on rubber or fluorocarbon rubber, a fluorocarbon resin such as PFA or PTFE, or a mixture of a fluorocarbon resin and a fluorocarbon rubber.

Note that in the present embodiment, an aluminum shaft with a diameter of 15 mm and a thickness of 0.5 mm is used as the core 53*a*. The heat-resistant release layer 53*b* is formed by applying PTFE to a thickness of 10 $\mu$m over the core 53*a* and annealing it.

Inside the heating roller 53, a heater lump 54 is provided as a heat source. In the present embodiment, an output of the heater lump 54 is set to 400 W.

On the heating roller 53, a thermostat 58 is provided in contact with the heating roller 53, as a safety device (heating suspending means) which works when the heating roller 53 per se has an extraordinarily high temperature due to, for example, a trouble of the control circuit 17. The thermostat 58 is provided between a power source (not shown) and the heater lump 54 in series and operates when the heating roller 53 has an extraordinarily high temperature, stopping power supply from the power source to the heater lump 54 so as to prevent a further temperature rise.

Besides, since the heating roller 53 is provided on the upstream side to the fixing nip region Y, a distance between the heating nip region Z to the fixing nip region Y can be minimized. Therefore, heat radiation to the air and to the insulating layer from the surface of the fixing roller 51 which is heated to the desired set temperature (180° C.) by the heating roller 53 is suppressed to a minimum level, and the thermal efficiency is improved. Furthermore, since the heating roller 53 is positioned close to the sheet of paper P coming into the fixing nip region Y, it is possible to achieve an effect of preliminary heating the sheet of paper P due to radiation from the heating roller 53 and conduction of heat therefrom through the air. This effect results in further improvement of fixation.

In the case where the heating roller 53 has some scars on its surface, such scars do not reversely affect fixed images, unlike the case where the fixing roller 51 has scars on its surface. Therefore, as described above, it is possible to provide the thermostat 58 in contact with the heating roller 53. By doing so, a temperature of the surface of the heating roller 53 can be more accurately detected by the thermostat 58. As a result, troubles of the heating roller 53, such as extraordinary temperature rise, can be quickly detected. With this, a temperature rise is prevented from occurring to the fixing roller 51 in such a case, and damages to the fixing device and the apparatus incorporating the fixing device are minimized.

The fixing device 50 is arranged so that offset of toner to the fixing roller 51 can be prevented by the self-cooling effect in the fixing nip region Y. However, when a trouble such as paper jam occurs, still toner may adhere to the fixing roller 51. Beside, paper dust may also adhere thereto. Such adhesion of toner and paper dust to the fixing roller 51 may reversely affect fixed images.

Therefore, to avoid such a problem, it is necessary to provide, to the fixing roller 51, cleaning means for removing toner, paper dust, and the like from the surface of the fixing roller 51.

Incidentally, in the aforementioned fixing device 50, the heating roller 53 is provided in contact with the surface of the fixing roller 51. This heating roller 53 may be made to function as cleaning means also. To be more specific, the surface of the heating roller 53 is made to have a more adhesive property with respect to the toner and paper dust than the adhesive property of the surface of the fixing roller 51, by omitting the heat-resistant release layer 53*b* of the heating roller 53, or by coating the surface of the heating roller 53 with a silicon rubber having an adhesive property, instead of the heat-resistant release layer 53*b*. By doing so, the cleaning of the surface of the fixing roller 51 can be executed with the use of the heating roller 53.

In the case where the heating roller 53 is used as cleaning means as described above, a cleaning pad 59 is provided under the heating roller 53 so that the cleaning pad 59 is in contact with the heating roller 53. Toner and paper dust adhering to the surface of the heating roller 53 are collected by this cleaning pad 59.

As described above, by making the heating roller 53 function as cleaning means, it is now unnecessary to provide discrete cleaning means, and reducing the size of the device and lowering the cost can be achieved.

The following description will explain the pressure roller 52 in detail.

The pressure roller 52 has a core 52*a* on which a heat-resistant release layer 52*b* is provided for preventing toner from adhering thereto, as illustrated in FIG. 1.

The core 52*a* is a cylinder or a hollow cylinder made of aluminum, stainless steel, or the like. In the present embodiment, as the core 52*a*, an aluminum shaft in a cylindrical form with a diameter of 30 mm is used.

The heat-resistant release layer 52*b* is made of a polymer material such as silicon rubber, a fluorocarbon resin such as PFA or PTFE, or a mixture of a fluorocarbon resin and a fluorocarbon rubber. In this case, the core 52*a* is coated with such a material, and the material forms the heat-resistant release layer 52*b*. Note that in the present embodiment, the heat-resistant release layer 52*b* is formed by applying PTFE over the core 52*b* to a thickness of 10 $\mu$m and annealing it.

Incidentally, since the fixing roller 51 has the insulating layer 51*b* having elasticity and has a hardness of as low as ASKER C 40°, the fixing roller 51 can be elastically deformed with a low pressure. Therefore, a sufficient fixing nip width Wf can be obtained only with the elastic deformation of the fixing roller 51. Accordingly, the pressure roller 52 may not be deformed, and hence there is no need to use expensive rubber material such as silicon rubber, which has conventionally been necessary as a material having elasticity. As a result, simplification of the structure of the pressure roller and lowering the cost can be achieved.

Besides, since the surface of the pressure roller 52 is not covered with a rubber material with a low thermal conductivity, heat is more easily conducted from the fixing roller 51 to the pressure roller 52. Therefore, pressure roller 52 is arranged as follows, with heat conducted from the fixing roller 51 taken into consideration.

In the case where a narrow sheet of paper such as a postcard or an envelope (hereinafter referred to as a small-size sheet) is transported through the fixing nip region Y, a heat quantity (per unit length) conducted from the fixing roller 51 to the small-size sheet in a part of the fixing nip region Y through which the small-size sheet goes (hereinafter referred to as paper-passing part) is given as Q2, whereas a heat quantity (per unit length) conducted from the fixing roller 51 to the pressure roller 52 in the other part of the fixing nip region Y through which the small-size sheet does not go (hereinafter referred to as non-paper-passing part) is given as Q1. Then, Q1 and Q2 are set so as to satisfy the following formula (1) in arranging the pressure roller 52:

$$Q1 \geqq Q2 \quad (1)$$

By thus arranging the pressure roller 52, heat in the fixing roller 51 easily lose heat through the pressure roller 52. Therefore, even in the case where small-size sheets are continuously passed through the fixing nip region Y, the temperature of the non-paper-passing part does not extraordinarily rise, and is rather kept at substantially the same level as that of the paper-passing part. As a result, it is possible to prevent problems such as an extraordinary rise of the temperature inside the device, a high-temperature offset phenomenon, and degradation of the self-cooling effect to cope with a temperature rise inside the fixing roller 51.

Incidentally, in the case where the pressure roller 52 is thus arranged so as to be superior in the conductivity, heat in the fixing roller 51 is likely to be lost through the pressure roller 52 during the warm-up of the fixing roller 51 as well, and the warm-up period may be prolonged. However, as explained in the description on the arrangement of the fixing device 50, the pressure roller 52 is provided so as to take the two states of being set away from the fixing roller 51 and being pressed against from the fixing roller 51, and the pressure roller 52 may be set away form the fixing roller 51 during the warm-up period. Thus, by making the pressure roller 52 in contact with the fixing roller 51 when necessary, permanent deformation of the fixing roller 51 caused by the pressure roller 52 pressing the fixing roller 51 is also prevented.

The pressure roller 52 has a higher hardness than that of the fixing roller 51, thereby encroaching upon the fixing roller 51 in the fixing nip region Y as shown in FIG. 1. In other words, the fixing roller 51 is depressed in the fixing nip region Y (the interface in the fixing nip region Y is curved to the fixing roller 51 side, that is, to an image side of the paper), and at the exit of the fixing nip region Y, the sheet of paper P is discharged from the fixing nip region in the rotation direction of the pressure roller 52. Therefore, without providing separating means such as a separating claw on the fixing roller 51 side for separating the sheet of paper P after fixation from the fixing roller 51, the sheet of paper P surely separates from the fixing roller 51.

Therefore, since the scarring of the fixing roller 51 with a separating claw aimed at separating of the sheet of paper from the fixing roller 51 by no means occurs, distortion of the image surface due to scars of the fixing roller surface caused by a separating claw, which has conventionally been a problem, can be avoided. Besides, since the sheet of paper P separates from the fixing roller 51 and goes along the pressure roller 52, it becomes easier to provide the thermistor 55*a* at the exit of the fixing nip region Y.

However, in the case where the sheet of paper P after fixation separates from the fixing roller 51 and is transported along the pressure roller 52 as described above, the sheet of paper P tends to be caught by the pressure roller 52, or the sheet of paper P tends to reversely curl (curl upwards in FIG. 1). However, as illustrated in FIG. 1, in the present embodiment, the separating claw 57 is provided at the exit of the fixing nip region Y, in contact with the pressure roller 52. Therefore, the sheet of paper P after the fixation is neither caught by the pressure roller 52, nor reversely curls.

In addition, since the pressure roller 52 has a high hardness and has no rubber material or the like on its surface, the surface of the pressure roller 52 is by no means scarred by the separating claw 57. Even if the surface of the pressure roller 52 is scarred, a fixed image is by no means affected by the scar, since the pressure roller 52 is in contact with the non-image forming surface of the sheet of paper P.

Moreover, the separating claw 57 has a separating surface 57*a* which is convex downward as illustrated in FIG. 1. Therefore, the sheet of paper P which has once reversely curled in the fixing nip region Y is curled in a right manner along the separating surface 57*a* of the separating claw 57 (curled so as to be convex downward, in FIG. 1). Therefore, the sheet of paper P is finally made flat, without curling.

Figure 7:
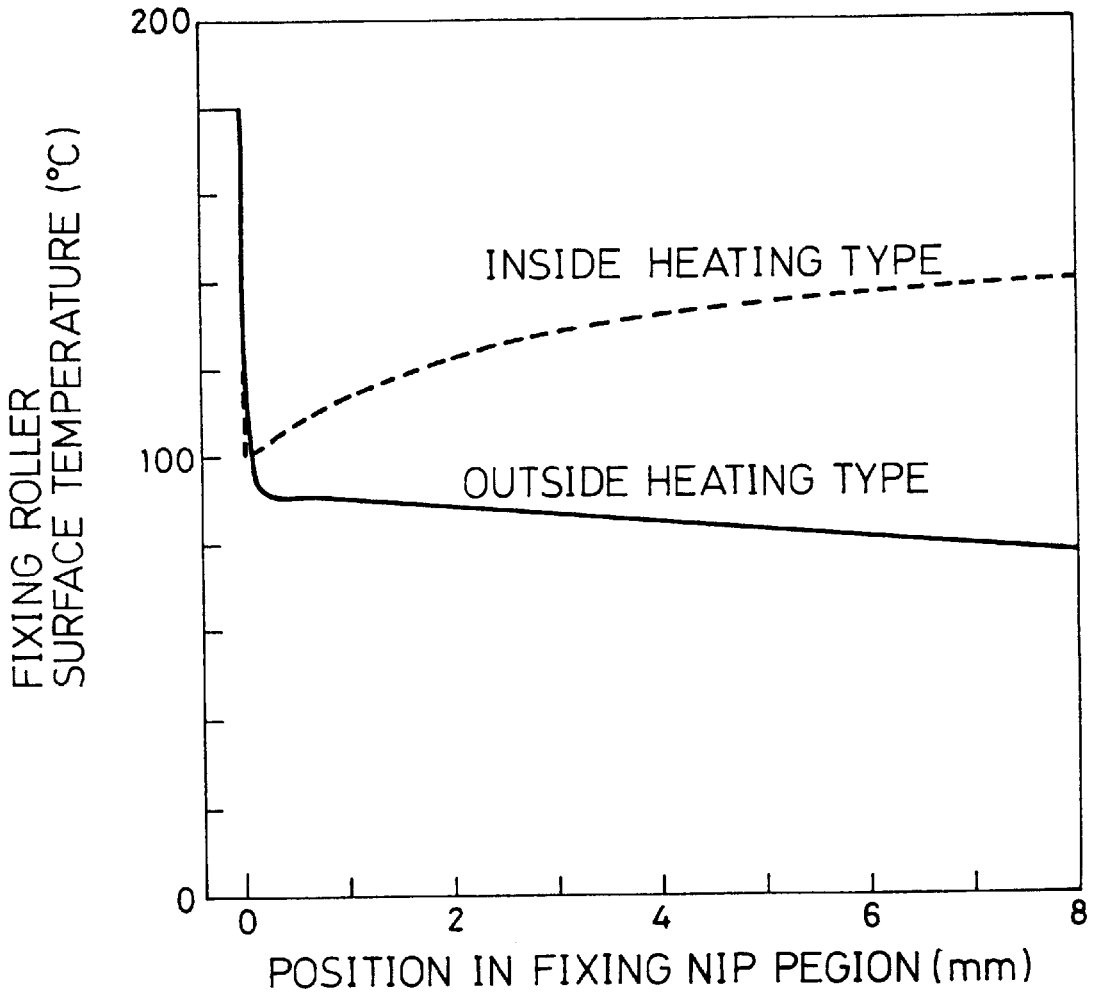
FIG. 7 is a graph illustrating, in respect to fixing devices of outside heating type and inside heating type, respective relations between positions in fixing nip regions and surface temperatures of fixing rollers at the positions.

In respect to the fixing device of outside heating type of the present embodiment and the conventional fixing device of inside heating type, surface temperatures of the fixing rollers in the fixing nip regions were calculated with the use of simulation models, and FIG. 7 illustrates results of the calculation. Herein, the fixing roller in the fixing device of inside heating type has a diameter of 30 mm, and is composed of an aluminum core in a hollow cylindrical shape with a thickness of 2 mm, a solid silicon rubber layer ( 1.5 mm thick) as an insulating layer, and a PFA tube as a cover layer (50 $\mu$m thick).

As clear from FIG. 7, the fixing roller surface temperature of the fixing device of outside heating type rapidly falls from the entrance to the fixing nip region, and thereafter no temperature rise is observed. On the other hand, the fixing roller surface temperature of the fixing device of inside heating type once drops at the entrance of the fixing nip region, and thereafter gradually rises. The reasons are as follows. In the case of the outside heating type, the fixing roller surface temperature gradually lowers, with heat therein being taken by the sheet of paper and the toner. On the other hand, in the case of the inside heating type, the fixing roller surface temperature once lowers at the entrance of the fixing nip region since the toner takes heat, but thereafter, with heat supplied from the inside of the fixing roller, the fixing roller surface temperature gradually rises, unlike the case of the outside heating type.

To compare the fixing devices of the two types, an experiment was carried out on fixing properties, whether or not offset occurs, and warm-up periods, and Table 2 below shows results of the experiment. Note that the fixing devices used in the present experiment were the same as those which were used as the simulation models above. Herein, the fixing nip width of the fixing device of inside heating type was set to 4.5 mm, whereas the fixing nip width of the fixing device of outside heating type was set to 8.0 mm. The fixing roller surface temperature at the entrance of the fixing nip region was set to 180° C. in both the fixing devices. The toner used in the present experiment was the same as the color toner used in the aforementioned theoretical experiment on prevention of offset.

TABLE 2

| | FIXING NIP WIDTH (mm) | FIXING ROLLER SURFACE TEMP. (C. °) FIXING NIP ENTRANCE | FIXING ROLLER SURFACE TEMP. (C. °) FIXING NIP EXIT | FALL OF TEMP. (° C.) | FIXING PROPERTY | OFFSET | WARM-UP PERIOD (SECOND) |
|---|---|---|---|---|---|---|---|
| INSIDE HEATING TYPE | 4.5 | 180 | 133 | 47 | ○ | X | 300 |
| OUTSIDE HEATING TYPE | 8.0 | 180 | 80 | 100 | ○ | ○ | 50 |

(1) In respect to the fixing property, a rubbing experiment was conducted, and o indicates that a ratio of remaining toner was not less than 90 percent, whereas x indicates that a ratio of remaining toner was less than 90 percent.

(2) In respect to the offset, o indicates that no offset occurred, whereas x indicates that offset occurred.

Clear from Table 2, in the case of the inside heating type, the surface of the fixing roller had a temperature of 133° C., higher than the melting point of the toner (105° C.), at the exit of the fixing nip region, and offset occurred. On the other hand, in the case of the outside heating type, due to the self-cooling effect, the surface of the fixing roller had a temperature of 80°0 C., lower than the melting point of the toner (105° C.), at the exit of the fixing nip region, and no offset occurred. Besides, in the case of the outside heating type, the warm-up period was remarkably shorter than that in the case of the inside heating type.

Second Embodiment

Figure 8:
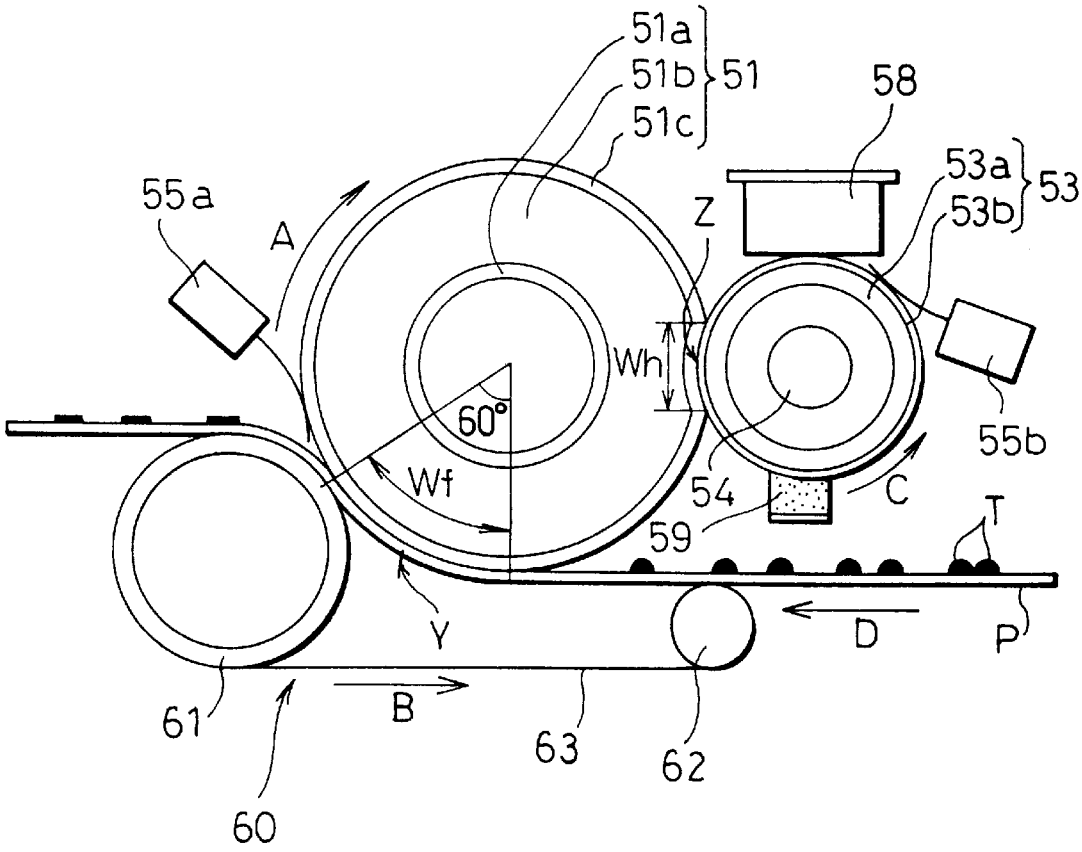
FIG. 8 is a view illustrating a schematic arrangement of a fixing device in accordance with another embodiment of the present invention.
Figure 9:
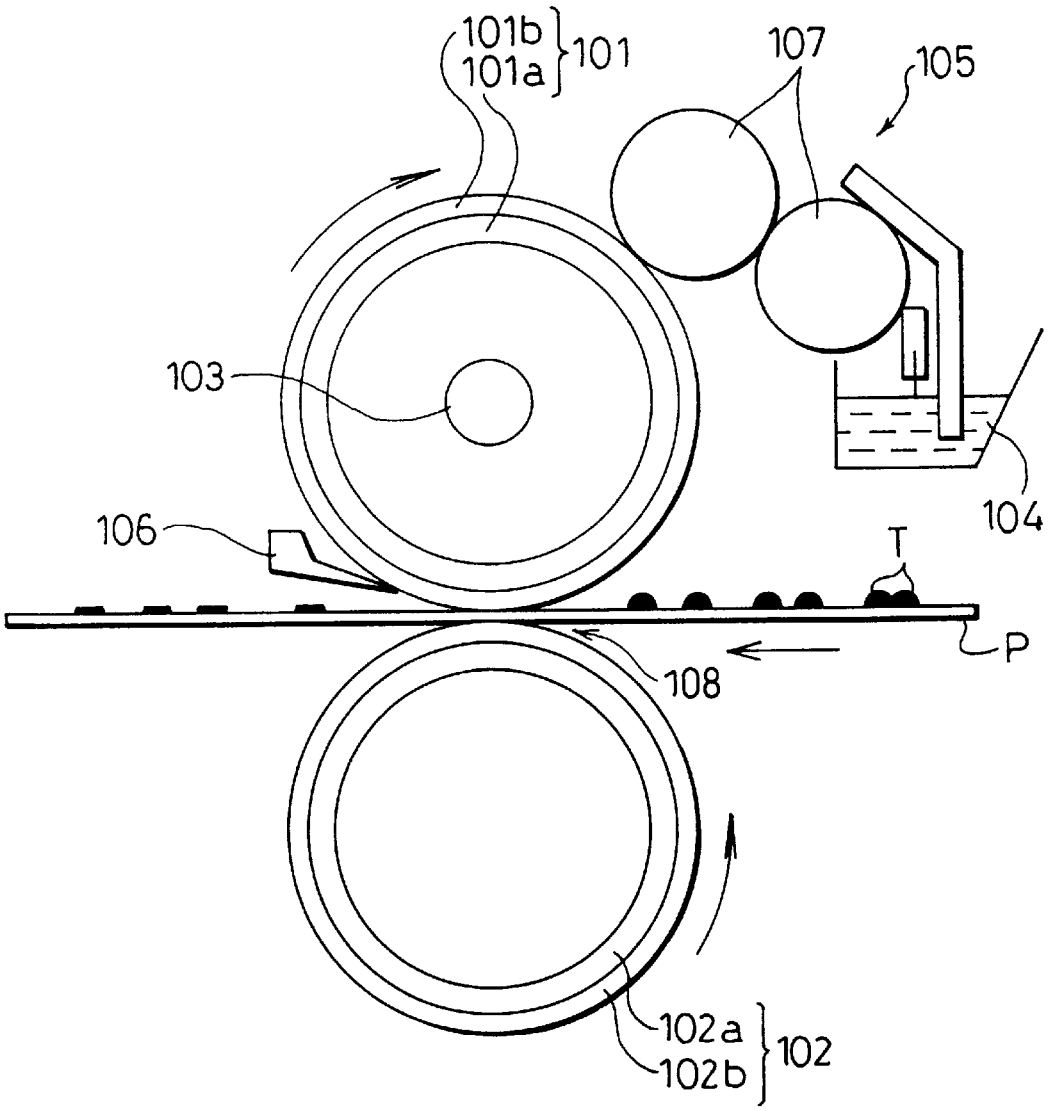
FIG. 9 is a view illustrating a schematic arrangement of a conventional fixing device of inside heating type.
Figure 10:
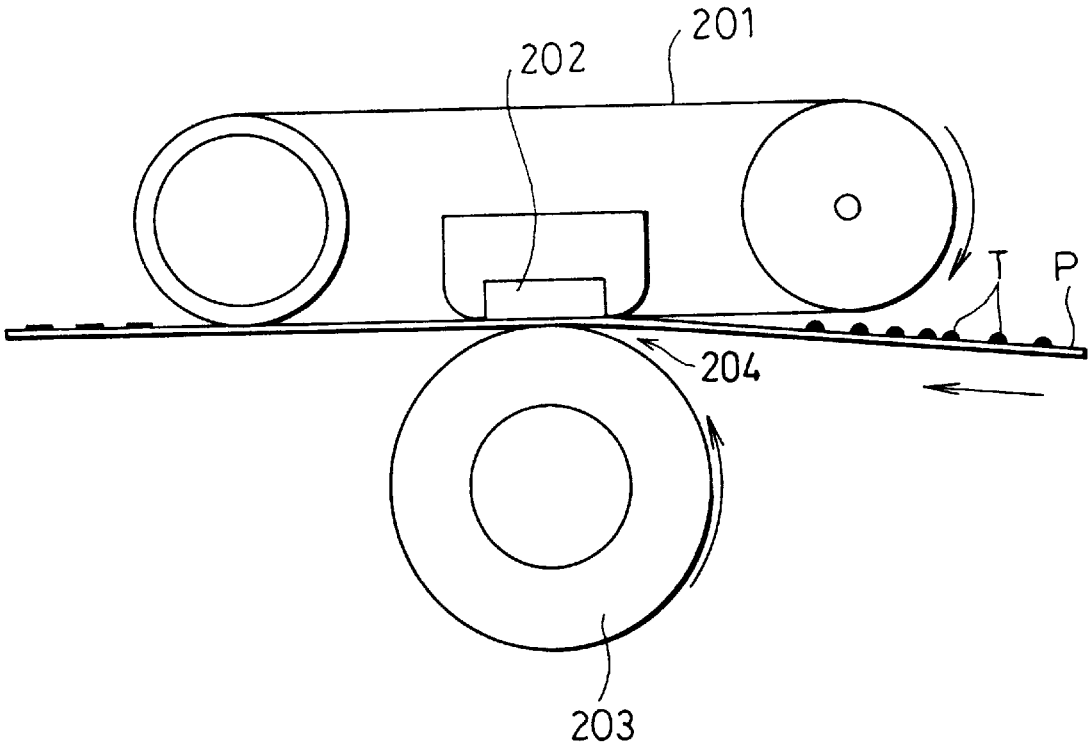
FIG. 10 is a view illustrating a schematic arrangement of a conventional fixing device of film heating type.

The following description will explain another embodiment of the present invention, while referring to FIG. 8. The members having the same structure (function) as those in the above-mentioned embodiment will be designated by the same reference numerals and their description will be omitted.

A fixing device of the present embodiment has a pressure system 60 as pressure means, in the place of the pressure roller 52 of the fixing device 50 of the first embodiment, as illustrated in FIG. 8. The other members constituting the fixing device of the present embodiment are the same as those in the first embodiment.

The pressure system 60 is arranged as follows. An endless belt 63 is stretched around two rollers 61 and 62 made of stainless steel with a tension of 5 kgf. The roller 61 is pressed toward a center of the fixing roller 51 by pressing means which is not shown, whereas the roller 62 is fixed at its position. With this arrangement, the endless belt 63 is pressed against the fixing roller 51, to form a fixing nip region Y. Herein, the endless belt 63 is brought in contact with the fixing roller 51 through a circumference angle of 60°, thereby causing the fixing nip region Y to have a width (fixing nip width) Wf of 15 mm.

The endless belt 63 is composed of a 100 $\mu$m thick polyimide film whose surface (a surface coming in contact with the fixing roller 51) is coated with a fluorocarbon resin to a thickness of 10 $\mu$m. The endless belt 63 and the rollers 61 and 62 are caused to rotate in an arrow B direction, following the rotation of the fixing roller 51.

Since the surface of the endless belt 63 which comes in contact with the fixing roller 51 is coated with the fluorocarbon resin, as described above, it is ensured that the endless belt 63 has heat resistance and a releasing property.

The following description will explain operations of the fixing device thus arranged.

To start with, during a printing operation, the heating roller 53 is heated by the heater lump 54, and a surface temperature of the heating roller 53 is detected by the thermistor 55*b*. In accordance with a detection signal on the surface temperature of the heating roller 53, the power supply to the heater lump 54 is controlled by the control circuit 17, so that a desired set temperature (220° C. in the present embodiment) is kept.

Then, the fixing roller 51 rotates in an arrow A direction, and is heated to a desired set temperature (180° C. in the present embodiment) in the heating nip region Z, by the heating roller 53 which is caused by the fixing roller 51 to rotate in an arrow C direction.

Thereafter, a sheet of paper P carrying an image formed with pre-fixed toner T is transported in an arrow D direction toward the fixing nip region Y, where the toner T electrostatically adhering to the sheet of paper P is fixed thereon with heat of the fixing roller 51 and pressure applied thereto in the fixing nip region Y.

As described above, as a result of utilizing the pressure system 60 wherein the endless belt 63 constitutes the pressure means for forming the fixing nip region Y in combination with the fixing roller 51, the pressure means is given elasticity. With this arrangement, the fixing nip width can be broadened with a low pressure. Therefore, the aforementioned self-cooling effect of the fixing roller 51 in the fixing nip region is further intensified, thereby improving the offset prevention effect and the fixing property.

In addition, since the fixing nip region Y formed by the endless belt 63 and the fixing roller 51 is wide and has a low pressure, this will not cause the sheet of paper P transported therethrough to deform, for example, curl along the fixing roller 51 or to reversely curl. Thus, with respect to the sheet of paper P transported through the fixing nip region, the fixation is carried out in a state where the sheet of paper P is substantially flat. Therefore, that the sheet of paper P is caught by the fixing roller 51 does not occur. As a result, the need to provide separating means for separating the sheet of paper P after the fixation from the fixing roller 51, such as a separating claw, is eliminated, and simplification of arrangement of the device is achieved while the size of the device is reduced.

Thus, in the aforementioned embodiments, the heating roller 53 which is caused to rotate by the rotation of the fixing roller 51 is used as heating means for heating the fixing roller 51. Therefore, no abrasion due to friction between the fixing roller 51 and the heating roller 53 occurs, and a stable heating operation is ensured. As a result, the fixing device can be applied to high-speed printing.

Moreover, though the case where the fixing device is applied to a monochromatic laser printer using one color type of toner is explained in the above present embodiments, it goes without saying that the present fixing device can be applied to an electrophotographic machine using several types of toners, such as a color laser printer or a color copying machine.

As has been described so far, the fixing device of the present invention comprises a fixing roller and pressure means for pressing a circumferential surface of the fixing roller, the fixing roller and the pressure means coming into contact in a heated contact region to which a recording material with a pre-fixed toner image thereon is transported so that the toner is melted with heat and fixed on the recording material, wherein the fixing roller is controllably heated from outside so that a surface portion of the fixing roller in a vicinity of an exit of the contact region constantly has a predetermined temperature during transport of the recording material through the contact region.

Since a method of heating the fixing roller surface from outside (outside heating method) is applied to the above fixing device, the fixing roller surface is more efficiently heated, as compared with the device to which a method of heating the fixing roller surface from inside (inside heating method) is applied. Therefore, the warm-up period of the fixing roller can be shortened. Besides, since the outside heating method is applied, the surface temperature of the fixing roller has already fallen at the exit of the contact region due to the self-cooling effect, and as a result offset can be prevented. Moreover, since the heating operation is controlled so that the fixing roller surface temperature in the vicinity of the exit of the contact region is kept to a predetermined level, it is possible to eliminate extraordinary temperature rise which, as a disadvantage of the conventional outside-heating-type device, usually occurs to the fixing roller in the case where the fixing operation is continuously carried out with respect to sheets of paper narrower than the fixing roller, such as postcards.

Moreover, the fixing device of the present invention, as described above, comprises a fixing roller and pressure means for pressing a circumferential surface of the fixing roller, the fixing roller and the pressure means coming into contact in a heated contact region to which a recording material with a pre-fixed toner image thereon is transported so that the toner is melted with heat and fixed on the recording material, and the fixing device further comprises (1) heating means for heating a surface of the fixing roller, the heating means being provided on an upstream side to the contact region, outside the fixing roller, (2) surface temperature detecting means for detecting a temperature of a surface portion of the fixing roller in a vicinity of an exit of the contact region, the surface temperature detecting means being provided on a downstream side to the contact region, and (3) heating control means for controlling the heating means based on an output of the surface temperature detecting means, so that the surface portion of the fixing roller in the vicinity of the exit of the contact region constantly has a predetermined temperature during transport of the recording material through the contact region.

Therefore, the surface of the fixing roller is heated from outside on an upstream side to the contact region of the fixing roller and the pressure means, the contact region is not directly supplied with heat. Accordingly, in the case where the recording material with a pre-fixed toner image is heated so that the toner is fixed thereon in the contact region, heat is taken from the fixing roller surface by the recording material and the toner (self-cooling effect), and the temperature falls.

Therefore, the toner which was once melted and fixed on the recording material in the contact region is now cooled due to the self-cooling effect of the fixing roller surface and comes to have a more cohesive force and a less adhesive force for adhering to the fixing roller, and thereafter the recording material separates away from the fixing roller. As a result, adhesion of toner to the fixing roller, that is, offset, does not occur.

This makes application of oil to the fixing roller for preventing offset unnecessary, thereby making a complicated oil applying system unnecessary, and as a result, reduction of a manufacturing cost of the fixing device and a longer service life of the fixing roller can be achieved.

The surface temperature of the fixing roller is detected in the vicinity of the contact region exit by the surface temperature detecting means, and the surface of the fixing roller in the vicinity of the contact region exit is controlled so as to have a predetermined temperature based on the detected temperature. Therefore, the temperature gradient of the fixing roller from the entrance to the exit of the contact region is stabilized. The temperature gradient is usually unstable, varying with the fixing conditions, such as ambient conditions, the number of sheets of paper having gone through the fixing operation, and types of recording materials, and this instability of the temperature gradient has been a problem of the conventional fixing devices of outside heating type. The instability of the gradient is solved by the aforementioned arrangement, and as a result, the following effect can be achieved: a stable fixing property and a stable toner releasing property can be ensured.

Furthermore, the fixing device of the present invention is, as described above, characterized in that the heating control means controls the heating means so as to satisfy:

$$To \leqq Tm$$

where To represents the temperature of the surface portion of the fixing roller in the vicinity of the exit of the contact region, and Tm represents a melting point of the toner.

Since the surface temperature To of the fixing roller in the vicinity of the contact region exit is controlled so as to be not higher than the toner melting point Tm at all times, the following effect can be achieved. Namely, a stable toner releasing property can be achieved, irrelevant to ambient conditions, the number of sheets of paper having gone through the fixing operation, or types of recording materials, and hence offset can be prevented.

Furthermore, the fixing device of the present invention is, as described above, characterized in that the fixing roller is composed of (1) a core provided on a rotation axis, (2) an insulating layer provided on a surface of the core, the insulating layer having elasticity, and (3) a cover layer provided on a circumferential surface of the insulating layer, the cover layer having a toner releasing property.

Since the fixing roller has the cover layer having the toner releasing property on its surface, the temperature gradient due to the self-cooling effect on the fixing roller surface can be made sharper by reducing a heat capacitance of the cover layer. As a result, both the toner fixing property and the toner releasing property are easily improved together.

Besides, since the insulating layer is elastic, a sufficient width of the contact region, that is, the fixing nip width, is obtained with a low pressure. On top of that, since heat of the cover layer is hardly lost through the insulating layer, the warm-up period of the fixing roller can be shortened.

Furthermore, the fixing device of the present invention is, as described above, characterized in that the insulating layer is made of aerated silicon rubber.

Since the aerated silicon rubber contains air bubbles inside, the insulating layer has an insulation property superior to that of solid silicon rubber containing no air bubbles. Therefore, by forming the insulating layer with the aerated silicon rubber, the insulation property is improved, and the warm-up period is shortened. Beside, since the aerated silicon rubber has a lower hardness, a broader nip width can be obtained with a lower pressure.

Furthermore, the fixing device of the present invention is, as described above, characterized in that (1) the aerated silicon rubber contains bubbles concatenated with each other, and (2) the core is in a hollow cylindrical form with a plurality of piercing pores.

Therefore, when the fixing roller is heated by the heating means and the air bubbles in the aerated silicon rubber as the insulating layer expand, the expanded air escapes from the concatenated bubbles through the piercing pores of the core. This allows the following effect to be achieved. Namely, an increase in an outside diameter of the fixing roller due to the air bubble expansion, which tends to occur in the case where the aerated silicon rubber is used for the insulating layer of the fixing roller, can be avoided, and the outside diameter of the fixing roller is kept constant at all times.

Furthermore, the fixing device of the present invention is, as described above, characterized in that the cover layer is made of tetrafluoroethylene-perfluoroalkyl vinyl ether copolymer resin.

Since the cover layer is made of tetrafluoroethylene-perfluoroalkyl vinyl ether copolymer resin, the cover layer is made to have an excellent toner releasing property, thereby resulting in that the offset prevention effect is further improved.

Furthermore, the fixing device of the present invention is, as described above, characterized in that the heating means is a heating roller which is rotatably provided in contact with the fixing roller.

Since the heating roller as heating means is provided in contact with the fixing roller and is caused to rotate by the rotation of the fixing roller, abrasion of the fixing roller due to friction with the heating means decreases. As a result, a service life of the fixing roller can be prolonged.

Furthermore, the fixing device of the present invention is, as described above, characterized in that the surface of the heating roller has an adhesive property.

Since the heating roller surface is adhesive, toner and paper dust adhering to the fixing roller can be collected by the heating roller. With this arrangement, the heating roller serves as the heating means for heating the fixing roller and as the cleaning means for cleaning the fixing roller at the same time. As a result, there is no need to provide discrete cleaning means, and hence the reducing of the device size and the lowering of the manufacturing cost can be achieved.

Furthermore, the fixing device of the present invention is, as described above, characterized in further comprising heating suspending means, provided in contact with a surface of the heating roller, for detecting a surface temperature of the heating roller, and suspending the heating operation of the heating roller when a detected temperature exceeds a predetermined temperature.

Since the heating operation of the heating roller is suspended by the heating suspending means in the case where the heating roller has a temperature exceeding the predetermined temperature, it is possible to prevent extraordinary temperature rise of the fixing roller, and minimize damage to the apparatus incorporating the fixing device. Moreover, since the heating means is provided in contact with the surface of the heating roller, the accuracy in the detection of extraordinary temperature rise of the heating roller is enhanced, thereby achieving the following effect. Namely, the prevention of extraordinary temperature rise of the fixing roller is ensured.

Furthermore, the fixing device of the present invention is, as described above, characterized in that the pressure means is arranged so that the following relationship is satisfied:

$$Q1 \geqq Q2$$

where Q1 represents a heat quantity per a unit length which is conducted from the fixing roller to the pressure means when the recording material is not passing through the contact region, and Q2 represents a heat quantity per a unit length which is conducted from the fixing roller to the recording material when the recording material is passing through the contact region.

Therefore, even in the case where recording materials narrower than the fixing roller, such as postcards or envelopes, are continuously transported through the contact region, heat in the non-paper-passing part of the fixing roller, which is not taken by the recording materials, the toner, and the like, goes to the pressure means side. With this arrangement, temperature rise in the non-paper-passing part of the fixing roller is prevented, and the following effect can be achieved. Namely, it is possible to prevent (1) temperature rise in the apparatus incorporating the fixing device, (2) a high-temperature offset phenomenon, and (3) degradation of the self-cooling effect due to temperature rise inside the fixing roller.

Furthermore, the fixing device of the present invention is, as described above, characterized in that the pressure means is separably provided with respect to the fixing roller, so that the pressure means is set away from the fixing roller during a warm-up period for warming-up of the surface of the fixing roller by the heating means.

Since the pressure means is set away from the fixing roller during the warm-up period, heat in the fixing roller is not lost through the pressure means during the warm-up period, even in the case where the pressure means is arranged so as to satisfy $Q1 \geqq Q2$ as described above. Therefore, an increase in the warm-up period for compensating lost heat through the pressure means is eliminated.

Besides, since the heating means is separably provided with respect to the fixing roller, the heating means is pressed against the fixing roller only when necessary. Therefore, permanent deformation of the fixing roller with pressure can be avoided.

Furthermore, the fixing device of the present invention is, as described above, characterized in that the pressing means is a pressure roller having (1) a metal core provided on a rotation axis, and (2) a heat-resistant release layer coating a surface of the metal core, the heat-resistant release layer being made of a fluorocarbon resin.

Since the heating means is a roller composed of a metal core covered with the heat-resistant release layer made of a fluorocarbon resin, a heat quantity conducted from the fixing roller to the pressure means is enough to satisfy the aforementioned condition of $Q1 \geqq Q2$, whereas the arrangement is simple, thereby lowering the manufacturing cost.

Moreover, the recording material after fixation is separated from the fixing roller along the pressure roller, an appropriate space is formed between the surface of the fixing roller and the recording material at the exit of the fixing nip region, and the temperature detecting means for detecting the surface temperature of the fixing roller in the vicinity of the fixing nip region exit may be positioned in this space. Therefore, the effect of facilitating the deposition of the temperature detecting means is achieved.

Furthermore, the fixing device of the present invention is, as described above, characterized in further comprising separating means for separating the recording material from the pressure roller after it is discharged from the contact region where the pressure roller and the fixing roller come into contact, the separating means being provided in the vicinity of the exit of the contact region.

Since the separating means is provided for preventing the recording material from being caught by the pressure roller after fixation, the effect of surely preventing the recording material from being caught can be achieved.

Furthermore, the fixing device of the present invention is, as described above, characterized in that the separating means has a separating surface convex to a side of the pressure roller.

Since the separating means has a separating surface convex to the pressure roller side, the recording material which curls to the fixing roller side after fixation is curled to the pressure roller side when it is separated from the pressure roller. By doing so, the curling of the recording material when coming out from the fixing nip region is corrected.

Furthermore, the fixing device of the present invention is, as described above, characterized in that the pressure means is an endless belt rotating in synchronization with the fixing roller.

With the above arrangement wherein the pressure means is an endless belt rotating in synchronization with fixing roller, the following effect can be achieved. Namely, a broader fixing nip width can be obtained with a lower pressure, as compared with the case where the pressure means is in a roller form, and the fixing property is improved. Besides, by broadening the fixing nip width, a larger region of contact between the fixing roller and the pressure means can be obtained, and the offset prevention effect due to the self-cooling effect of the fixing roller can be further enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixing device, comprising a fixing roller and pressure means for pressing a circumferential surface of said fixing roller, said fixing roller and said pressure means coming into contact in a contact region to which a recording material with a pre-fixed toner image thereon is transported so that the toner is melted with heat and fixed on the recording material, wherein, during transport of the recording material through the contact region, said fixing roller is controllably heated from outside so as to satisfy:

$$To \leqq Tm$$

where To represents a temperature of a surface portion of said fixing roller in a vicinity of an exit of the contact region, and Tm represents a melting point of the toner.

2. A fixing device comprising a fixing roller and pressure means for pressing a circumferential surface of said fixing roller, said fixing roller and said pressure means coming into contact in a contact region to which a recording material with a pre-fixed toner image thereon is transported so that the toner is melted with heat and fixed on the recording material, said fixing device further comprising:

heating means for heating a surface of said fixing roller, said heating means being provided on an upstream side to the contact region, outside the fixing roller;

surface temperature detecting means for detecting a temperature of a surface portion of said fixing roller in a vicinity of an exit of the contact region, said surface temperature detecting means being provided on a downstream side to the contact region; and heating control means for controlling said heating means based on an output of said surface temperature detecting means, during the transport of the recording material through the contact region, so as to satisfy:

$$To \leqq Tm$$

where To represents a temperature of a surface portion of said fixing roller in a vicinity of an exit of the contact region, and Tm represents a melting point of the toner.

3. The fixing device as set forth in claim 2, wherein said fixing roller is composed of:

a core provided on a rotation axis;

an insulating layer provided on a surface of the core, the insulating layer having elasticity; and a cover layer provided on a circumferential surface of the insulating layer, the cover layer having a toner releasing property.

4. The fixing device as set forth in claim 3, wherein the insulating layer is made of aerated silicon rubber.

5. The fixing device as set forth in claim 4, wherein:

the aerated silicon rubber contains bubbles concatenated with each other; and the core is in a hollow cylindrical form with a plurality of piercing pores.

6. The fixing device as set forth in claim 3, wherein the cover layer is made of tetrafluoroethylene-perfluoroalkyl vinyl ether copolymer resin.

7. The fixing device as set forth in claim 2, wherein said heating means is a heating roller which is rotatably provided in contact with said fixing roller.

8. The fixing device as set forth in claim 7, wherein said heating roller has an adhesive property.

9. The fixing device as set forth in claim 7, further comprising:

heating suspending means, provided in contact with a surface of said heating roller, for detecting a surface temperature of said heating roller, and suspending the heating operation of said heating roller when a detected temperature exceeds a predetermined temperature.

10. The fixing device as set forth in claim 2, wherein said pressure means is arranged so that the following relationship is satisfied:

$$Q1 \geqq Q2$$

where Q1 represents a heat quantity per a unit length which is conducted from said fixing roller to said pressure means when the recording material is not passing through the contact region, and Q2 represents a heat quantity per a unit length which is conducted from said fixing roller to the recording material when the recording material is passing through the contact region.

11. The fixing device as set forth in claim 2, wherein said pressure means is separably provided with respect to said fixing roller, so that said pressure means is set away from said fixing roller during a warm-up period for warming-up of the surface of said fixing roller by said heating means.

12. The fixing device as set forth in claim 2, wherein said pressing means is a pressure roller, said pressure roller having:

a metal core provided on a rotation axis; and a heat-resistant release layer coating a surface of the metal core, the heat-resistant release layer being made of a fluorocarbon resin.

13. The fixing device as set forth in claim 12, further comprising:

separating means for separating the recording material from said pressure roller after it is discharged from the contact region where said pressure roller and said fixing roller come into contact, said separating means being provided in the vicinity of the exit of the contact region.

14. The fixing device as set forth in claim 13, wherein said separating means has a separating surface convex to a side of said pressure roller.

15. The fixing device as set forth in claim 2, wherein said pressure means is an endless belt rotating in synchronization with said fixing roller.

16. A fixing method for melting toner with heat and fixing the same on a recording material by transporting the recording material with a pre-fixed toner image thereon to a contact region in which a fixing roller and pressure means for pressing a circumferential surface of the fixing roller come into contact, the method comprising the steps of:

heating and controlling the fixing roller from outside, during transport of the recording material through the contact region, so as to satisfy:

$$To \leqq Tm$$

where To represents a temperature of a surface portion of said fixing roller in a vicinity of an exit of the contact region, and Tm represents a melting point of the toner.

* * * * *